US007017552B2

(12) United States Patent
Gerhardy

(10) Patent No.: US 7,017,552 B2
(45) Date of Patent: Mar. 28, 2006

(54) OPERATING MECHANISM

(75) Inventor: Reinhard Gerhardy, Korb (DE)

(73) Assignee: Andreas Stihl AG & Co. KG, (DE)

( * ) Notice: Subject to any disclaimer, the term of this patent is extended or adjusted under 35 U.S.C. 154(b) by 31 days.

(21) Appl. No.: 10/641,868

(22) Filed: Aug. 15, 2003

(65) Prior Publication Data

US 2004/0035394 A1 Feb. 26, 2004

(30) Foreign Application Priority Data

Aug. 22, 2002 (DE) ..... 102 38 364

(51) Int. Cl.
*F02D 1/00* (2006.01)

(52) U.S. Cl. ..... 123/400; 74/42

(58) Field of Classification Search ..... 123/400; 74/42, 40, 48, 49, 469, 519, 522
See application file for complete search history.

(56) References Cited

U.S. PATENT DOCUMENTS 4,075,985 A 2/1978 Iwai
5,699,768 A 12/1997 Saito et al.
5,964,203 A * 10/1999 Sato et al. ..... 123/396
6,536,409 B1 * 3/2003 Takahashi et al. ..... 123/336
6,561,861 B1 * 5/2003 Ikuma et al. ..... 123/336
6,575,875 B1 * 6/2003 Holmes ..... 477/121
6,698,397 B1 * 3/2004 Cook ..... 123/399
6,761,145 B1 * 7/2004 Matsuda et al. ..... 123/342

FOREIGN PATENT DOCUMENTS

EP 0 395 005 10/1990

* cited by examiner

*Primary Examiner*—John T. Kwon
(74) *Attorney, Agent, or Firm*—Robert W Becker & Associates; Robert W Becker

(57) ABSTRACT

An operating mechanism is provided and has an operating lever, an adjusting lever, and a valve element that is rotatably disposed in a channel, wherein the adjusting lever is connected with the valve element via a shaft. A coupling element is provided for interconnecting the positions of the operating lever and the adjusting lever. The distance of the pivot axis of the adjusting lever from a connection of the coupling element with the adjusting lever is variable as a function of the position of the adjusting lever.

11 Claims, 3 Drawing Sheets

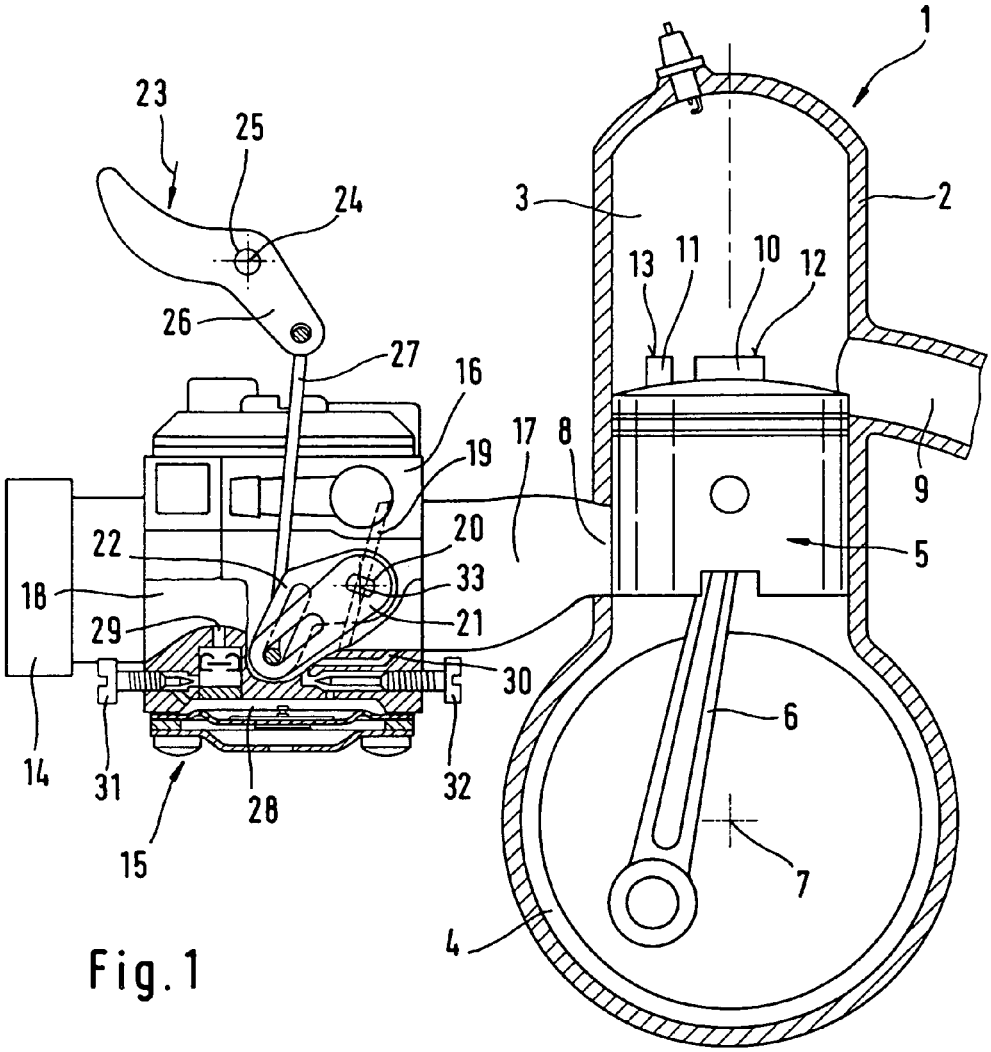
Fig. 1
Fig. 6
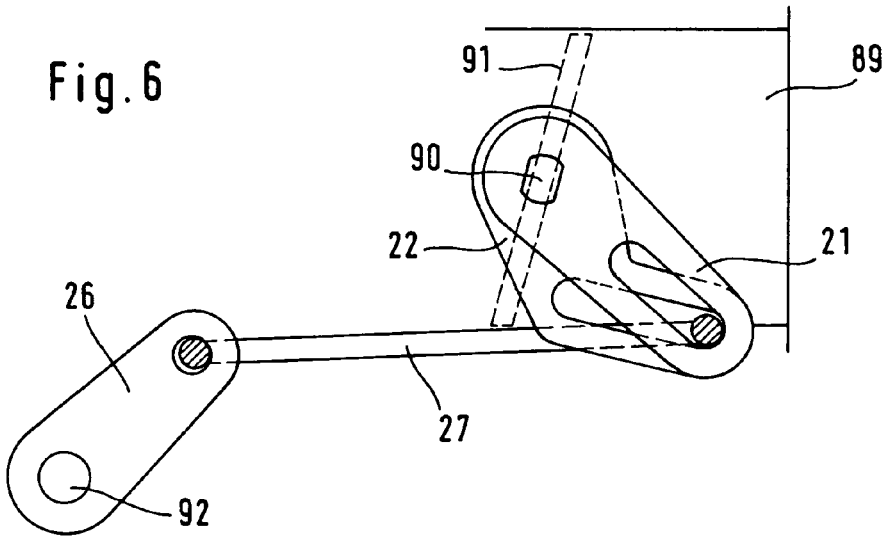

OPERATING MECHANISM

BACKGROUND OF THE INVENTION

The present invention relates to an operating mechanism.

A mechanism is known from U.S. Pat. No. 4,075,985, whereby a throttle valve pivotably retained in a suction passage is coupled with an air valve pivotably retained in an air passage. A throttle lever fixedly joined to the throttle shaft is rigidly coupled with a lever on the air valve shaft by means of a coupling rod. Air valve and throttle valve therefore open and close uniformly so that the opening angle of the throttle valve plotted against the opening angle of the air valve assumes a linear course. In different applications, however, a non-linear coupling between two levers is desirable.

The underlying objective of the invention is to propose an operating mechanism of the aforementioned general type, providing a simple means of obtaining a non-linear coupling between an operating lever and an adjusting lever.

SUMMARY OF THE INVENTION

This objective is achieved by an operating mechanism that has an operating lever, an adjusting lever, a valve element that is rotatably disposed in a channel, wherein the adjusting lever is connected with the valve element via a shaft, and a coupling element for interconnecting the positions of the operating lever and of the adjusting lever, wherein the distance of the pivot axis of the adjusting lever from a connection of the coupling element with the adjusting lever is variable as a function of the position of the adjusting lever.

Changing the distance between the pivot axis of the lever and the link joining the coupling element to the lever causes a non-linear pivoting motion of the lever linked via the coupling element when the lever is uniformly rotated. The coupling characteristics of the two levers can be adjusted during the course of the change in distance.

For practical purposes, the coupling element is linked to the lever by means of a bolt, which is fixedly joined to the coupling element and is guided in a first slot. A link of this type between coupling element and lever is easy to manufacture and provides a reliable coupling between the coupling element and lever during operation.

In order to change the distance, the bolt is guided in a second slot and the slot is provided in a component relative to which the lever effects a relative displacement. The relative displacement of the slots causes a forced guiding action of the bolt at the intersection of the two slots. A second slot of this type provides a simple means of forcibly guiding the bolt in the slot and is functionally reliable. For practical purposes, the longitudinal axes of the slots form an angle $\alpha$ whatever the position of the lever. This determines the position of the lever in the slots in every lever position. It may also be of practical advantage if the slots extend parallel in specific lever positions so that the bolt is displaceable without the lever moving. This enables an idle path to be established for one lever relative to the other.

The second slot is provided in a second lever, mounted so as to rotate about the pivot axis. In order to ensure a forced guiding action in the slots, the second lever is spring-biased. The design of the spring will contribute to determining the coupling characteristics. The first slot expediently extends radially to the pivot axis. The adjusting lever is specifically joined to the throttle shaft, prevented from rotating, of a carburetor, in particular for the two-stroke motor of a hand-held power tool. An advantageous opening characteristic can be obtained if the distance decreases, the farther a throttle valve forming the valve element opens.

The coupling element can be coupled with the operating lever in a simple arrangement if the operating lever has a bore in which a bolt joined to the coupling element is guided. For practical purposes, the coupling element is a coupling rod.

BRIEF DESCRIPTION OF THE DRAWINGS

Exemplary embodiments of the invention will be explained with reference to the appended drawings. Of these:

FIG. 1 is a schematic diagram of an operating mechanism for the carburettor of a two-stroke motor, FIG. 6 is a side view of the second coupled lever.

DESCRIPTION OF PREFERRED EMBODIMENTS

Figure 2:
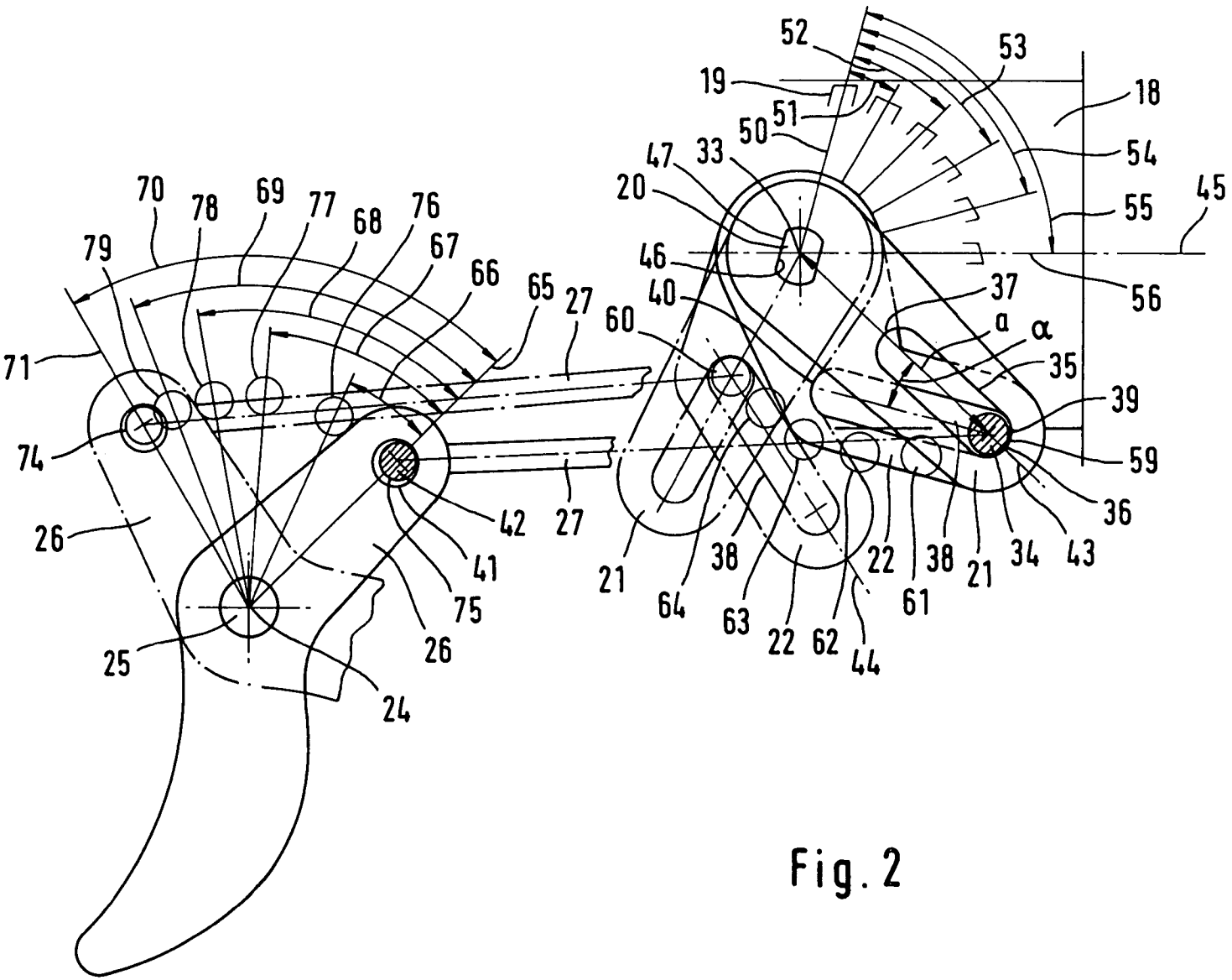
FIG. 2 is a schematic side view of the coupling, illustrating the two end positions of the coupling.

FIG. 1 depicts how the operating mechanism is used to open the throttle or butterfly valve of a carburetor. The purpose of the carburetor is to deliver the fuel/air mixture to a motor, in particular a two-stroke motor in a hand-held power tool such as a power chain saw, a disc grinder or the like. The two-stroke motor 1 schematically illustrated in FIG. 1 has a cylinder 2, in which a combustion chamber 3 is provided. The combustion chamber 3 is bounded by a reciprocating piston 5, which drives a crankshaft 7 rotatably mounted in a crankcase 4 via a connecting rod 6. Opening into the crankcase 4 is an inlet 8, through which the fuel/air mixture is delivered to the crankcase 4. The exhaust gases are discharged from the combustion chamber 3 through an outlet 9. Transfer passages 10 close to the outlet and two transfer passages 11 remote from the outlet establish a flow-connection between crankcase 4 and combustion chamber 3 when the piston 5 is in predefined positions. The transfer passages 10 close to the outlet, of which only one is illustrated in FIG. 1, open into the combustion chamber 3 at a transfer window 12 whilst the transfer passages 11 remote from the outlet open into the combustion chamber 3 at a transfer window 13. The cylinder 2 expediently has four transfer passages disposed symmetrically relative to an approximately central plane dividing the inlet 8 and outlet 9. However, it might also be expedient to use a different layout and/or different number of transfer passages.

The fuel/air mixture is delivered to the crankcase 4 via a suction passage 17. Disposed in the suction passage or intake channel 17 is a carburetor 15 with a carburetor housing 16, in which a suction passage or intake channel section 18 is disposed. A throttle or butterfly valve 19 with a throttle shaft 20 is rotatably mounted in the suction passage section 18. The throttle valve 19 forms a valve element, by means of which the flow cross-section of the suction passage 17 can be varied. An adjusting lever 21 is arranged on the throttle shaft, fixed so as to be prevented from rotating. The operating lever 26 is coupled with the adjusting lever 21 via a coupling rod 27. A second lever 22 is rotatably mounted on the throttle shaft 20. Upstream of the throttle valve 19 is an air filter 14. The operating lever 26 is mounted on a shaft 25 so as to pivot about the pivot axis 24. For operating purposes, the operating lever 26 is pivoted in the direction of arrow 23.

Opening into the suction passage section 18 in the region of the throttle valve 20 are a fuel-conveying main nozzle 29 and one or more idler nozzles 30. The main nozzle 29 and idler nozzles 30 are supplied from a fuel-filled control chamber 28. The quantity of fuel delivered to the suction passage section 18 can be adjusted by means of a main adjusting screw 31 and an idler adjusting screw 32.

The coupling between operating lever 26 and adjusting lever 21 is illustrated on an enlarged scale in FIG. 2. Compared with FIG. 1, the levers 21 and 22 disposed on the throttle shaft 20 are shown rotated on the throttle shaft 20 towards the suction passage section 18. The adjusting lever 21 is disposed on the throttle shaft 20 so as to be prevented from rotating. To this end, the throttle shaft 20 has flattened regions 46, which project into a slit 47 in the adjusting lever 21. A second lever 22 is rotatably mounted on the throttle shaft 20, disposed between the adjusting lever 21 and the carburetor housing 16. The adjusting lever 21 has a first slot 35 extending in a radial direction towards the pivot axis 33, in which a bolt 34 is guided. The pivot axis 33 simultaneously constitutes the longitudinal axis of the throttle shaft 20. The bolt 34 is arranged on a coupling rod 27. At its other end, the coupling rod 27 has a bolt 42, which is mounted in a bore 41 in the operating lever 26.

Bolt 34 guided in the slot 35 is guided in a second slot 38 provided in the second lever 22. The longitudinal axis 44 of the second slot 38 forms an angle $\alpha$ with the longitudinal axis 43 of the first slot 35 which is greater than 0 whatever the relative position of the two levers 21, 22. In FIG. 2, the levers 21 and 22 as well as the operating lever 26 are illustrated in the position they assume when the throttle valve is in the closed position denoted by reference 50 and in the open position denoted by reference 56. In position 56, the adjusting lever 21 has been pivoted from position 50 about the pivot axis 33 by 75. The position of the throttle valve 19 is merely indicated in FIG. 2. When the throttle valve 19 is in the open position 56, bolt 34 is disposed in the region of the radially outer point 36 of the first slot 35 and in the region of the radially outer point 39 of the second slot 38. The bolt 34 is at a distance a from the pivot axis 33 of the adjusting lever 21.

As the throttle valve 19 is opened, the distance a of the bolt 34 from the pivot axis 33 of the adjusting lever 21 continuously decreases. When the throttle valve is fully open, bolt 34 is disposed at the radially inner point 37 of the first slot 35 and at the radially inner point 40 of the second slot 38.

FIG. 2 schematically illustrates several positions of the bolt 34 and the bolt 42 as well as the corresponding angular positions of throttle valve 19 and operating lever 26. In the closed position 50, the schematically indicated throttle valve 19 closes off the suction passage section 18 so as to render it substantially airtight. Bolt 34 is disposed in position 59. When the throttle valve 19 is opened by an angle 51, which in FIG. 2 is 15°, bolt 34 is in position 61. Bolt 42 linked to bolt 34 via the coupling rod 27 has rotated out of the position denoted by reference 75, which corresponds to the position of the operating lever 26 denoted by reference 65, about the pivot axis 24 by an angle 66 into position 76. In position 61, bolt 34 is at a distance from the pivot axis 33 of the adjusting lever 21 that is smaller than the distance a when the throttle valve 19 is in the closed position. Angle 66 is greater than angle 51 and in particular may be 23°. The operating lever 26 is therefore rotated into this position from position 65 by 23°.

When the throttle valve is opened by an angle 52, which in particular is 30°, bolt 34 is in position 62 and bolt 42 in position 77. The angle 67 about which the operating lever 26 is pivoted is 42°, for example. When the throttle valve 19 is opened by an angle 53, which is 45°, bolt 34 is in position 63, bolt 42 in position 78 and the operating lever is pivoted by an angle 68 of 55°, for example. When the throttle valve 19 is at an angle 54 of 60°, bolt 34 is in a position 65, bolt 42 in position 79 and the angle 69 by which the operating lever 26 is pivoted is expediently 66°. In the open position 56, the throttle valve 19 is opened by an angle 55 corresponding to 75°. Accordingly, the operating lever 26 is opened to position 71 by an angle 70 of 75°. The throttle valve 19 lies parallel with the longitudinal axis 45 of the suction passage section 18. Bolt 34 is disposed in position 60 and bolt 42 in position 74.

Figure 5:
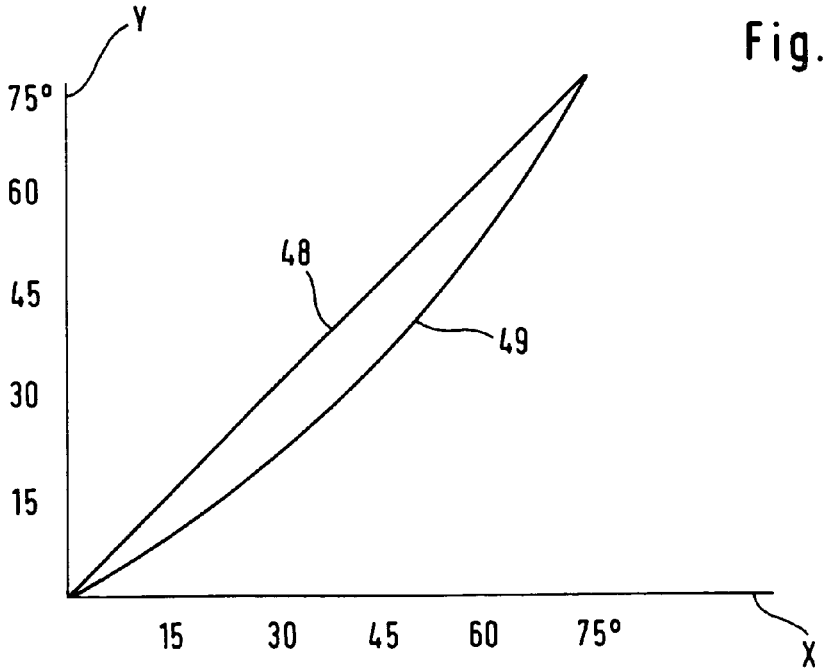
FIG. 5 is a diagram plotting the rotary motion of the lever.

The graph in FIG. 5 plots the angle of the throttle valve 19 over the angle by which the operating lever 26 is pivoted. The angle of the throttle valve 19 is plotted on the Y axis and the angle of the operating lever 26 on the X axis. The characteristic curve 48 assumes a linear course such as would occur with a fixed coupling of the lever. Characteristic curve 49 plots the progressive course of the angle of the throttle valve 19 over the angle of the operating lever 26, resulting from the arrangement illustrated in FIG. 2. At the start of the pivoting motion of the operating lever 26, the throttle valve 19 opens more slowly. Consequently, the position of the throttle valve 19 can be effectively controlled when the motor is at low speed and low load. As the throttle valve 19 opens wider, it opens more quickly for a shorter pivoting motion of the operating lever 26, causing line 49 to assume a progressive curve.

Figure 3:
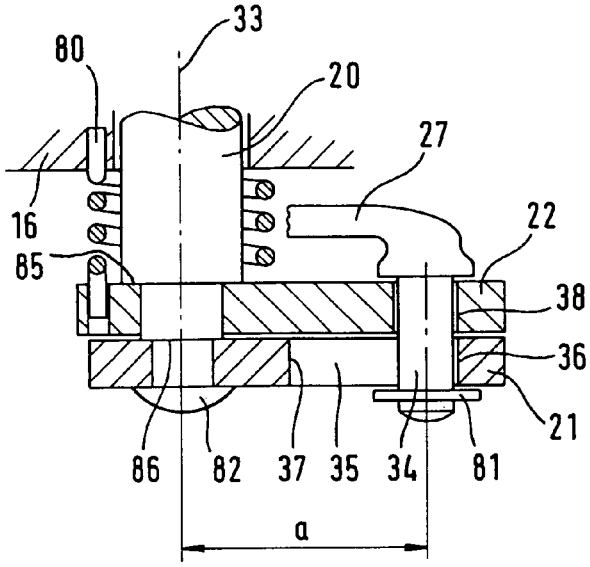
FIG. 3 is a section through a shaft with levers arranged thereon.

The coupling between the adjusting lever 21 and the second lever 22 is illustrated in FIG. 3, in section along the longitudinal axis 43 of the slot 35 in the adjusting lever 21. The throttle shaft 20 is retained on the carburetor housing 16. Fixed to the carburetor housing 16 is a compression spring 80, extending coaxially with the throttle shaft 20, the second end of which is fixed to the second lever 22. The compression spring 80 biases the second lever 22 towards the open position 56 of the throttle valve 19. The bolt 34 is guided in a slot 38 in the second lever 22. The second lever 22 is rotatably mounted on throttle shaft 20 on a step 85. On the side of the second lever 22 remote from the carburetor housing 16, the adjusting lever 21 is mounted on a shoulder 86 of the throttle shaft 20 so as to be prevented from rotating. Towards the pivot axis 33, the adjusting lever 21 is joined to the throttle shaft 20 by means of a rivet 82. Bolt 34 is guided in the radially extending slot 35. The bolt 34 is secured in the axial direction by a spring or snap ring. The coupling rod 27 is provided on the opposite side of the bolt 34 directed towards the carburetor housing 16 and is fixedly joined to the bolt 34.

When the two levers are displaced relative to one another, the bolt 34 moves towards the pivot axis 33 of the throttle shaft 20. The distance of the link between the coupling rod 27 and the adjusting lever 21 is therefore decreased. The second lever 22 is biassed in the opening direction of the throttle valve 19 by the spring 80. The spring force counteracts the movement of the bolt 34 in the slot 35. Coordinating the spring force accordingly ensures that the distance a continuously decreases as the throttle valve 19 is opened farther. This ensures a progressive curve as illustrated by characteristic curve 49 in FIG. 5.

Figure 4:
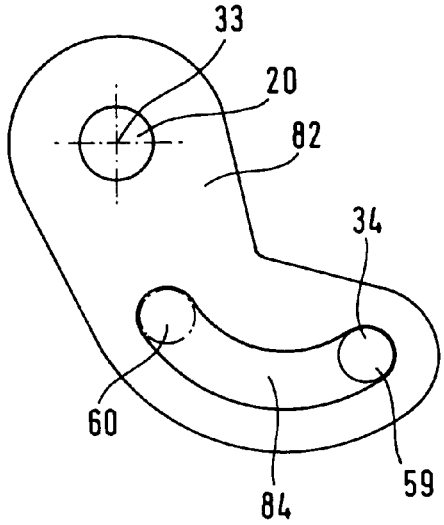
FIG. 4 is a side view of a different embodiment of the second lever.

FIG. 4 illustrates an embodiment of the second lever. The second lever 82 has an arcuate slot 84. The slot 84 is inclined with respect to the pivot axis 33 of the adjusting lever 21 at every point in the radial direction. Consequently, the distance a of the bolt 34 from the pivot axis 33 decreases continuously from position 59 to position 60. The second lever may also be coupled with the adjusting lever by means other than a spring, for example via a gear system or the like.

It may be expedient to use the operating mechanism to couple the throttle valve with an air valve. This being the case, the air valve is disposed in particular in an air passage which delivers additional combustion air to the motor. The combustion air can then be delivered to the transfer passage of the motor and used as scavenging air. FIG. 6 illustrates how an air valve 91 is coupled with a throttle valve, not illustrated in FIG. 6. The coupling between the operating lever 26 and the adjusting lever 21 corresponds to the coupling illustrated in FIG. 2. With the layout illustrated in FIG. 6, the operating lever 26 is arranged on the throttle shaft 92, however, on which the throttle valve is mounted so that it cannot rotate. The adjusting lever 21 and the second lever 22 are disposed on the air valve shaft 90, to which the air valve 91 is attached. The air valve 91 is pivotably mounted in an air passage 89. Coupling the levers means that the air passage will be opened only slowly at first. At lower speeds, a rich fuel/air mixture will therefore be delivered to the motor. At high speeds, the air valve 91 is opened over-proportionately so that a lean fuel/air mixture more conducive to high speeds is formed and the exhaust gas values are not adversely affected due to excess delivery of fuel.

The design of the slots and the layout of adjusting lever and operating lever enable a whole range of coupling characteristics to be achieved. The slots in the two levers may extend parallel with one another in one region, in particular in a region bordering the closed position of the throttle valve, so that the bolt is able to move in the slots and the throttle valve is able to effect an idle movement relative to the operating lever. Various other structural designs could advantageously be used in order to shorten the distance between the pivot axis 33 and the link of the adjusting lever to the coupling rod 27.

For practical purposes, the operating mechanism may be used in hand-held power tools such as power chain saws, cutting equipment, disc grinders and the like. However, the operating mechanism may advantageously be used in other applications.

The specification incorporates by reference the disclosure of German priority document 102 38 364.2 filed Aug. 22, 2002.

The present invention is, of course, in no way restricted to the specific disclosure of the specification and drawings, but also encompasses any modifications within the scope of the appended claims.

The invention claimed is:

1. An operating mechanism, comprising:

an operating lever;

an adjusting lever;

a valve element that is rotatably disposed in a channel, wherein said adjusting lever is connected with said valve element via a shaft; and a coupling element for interconnecting positions of said operating lever and said adjusting lever, wherein a distance of a pivot axis of said adjusting lever from a connection of said coupling element with said adjusting lever is variable as a function of a position of said adjusting lever, so that the pivot axis of the adjusting lever has a predetermined first distance from the connection of the coupling element to the adjusting lever in a first position of the adjusting lever and a predetermined second distance in a second position of the adjusting lever, wherein the first distance is less than the second distance, and wherein the distance depends on the position of the adjusting lever.

2. An operating mechanism according to claim 1, wherein a bolt is provided for forming said connection of said coupling element with said adjusting lever, wherein said bolt is connected with said coupling element, and wherein said bolt is guided in a first slot that is disposed in said adjusting lever.

3. An operating mechanism, comprising:

an operating lever;

an adjusting lever;

a valve element that is rotatably disposed in a channel, wherein said adjusting lever is connected with said valve element via a shaft; and a coupling element for interconnecting positions of said operating lever and said adjusting lever, wherein a distance of a pivot axis of said adjusting lever from a connection of said coupling element with said adjusting lever is variable as a function of a position of said adjusting lever, wherein a bolt is provided for forming said connection of said coupling element with said adjusting lever, wherein said bolt is connected with said coupling element, wherein said bolt is guided in a first slot that is disposed in said adjusting lever, wherein said bolt is guided in a second slot, and wherein said second slot is disposed in a component relative to which said adjusting lever carries out a relative movement.

4. An operating mechanism according to claim 3, wherein in every position of said valve element, longitudinal axes of said slots form an angle.

5. An operating mechanism according to claim 4, wherein said second slot is formed in a second lever that is mounted so as to be rotatable about said pivot axis of said adjusting lever.

6. An operating mechanism according to claim 5, wherein said second lever is spring-biased.

7. An operating mechanism according to claim 2, wherein said first slot 35 extends radially relative to said pivot axis of said adjusting lever.

8. An operating mechanism according to claim 1, wherein said adjusting lever is fixedly connected with a throttle shaft of a carburetor.

9. An operating mechanism according to claim 8, wherein said valve element is a butterfly valve, and wherein said distance of said pivot axis from said connection of said coupling element with said adjusting lever is reduced as said butterfly valve increases in opening.

10. An operating mechanism according to claim 1, wherein said operating lever is provided with a bore in which is guided a bolt that is connected with said coupling element.

11. An operating mechanism according to claim 1, wherein said coupling element is a coupling rod.

* * * * *